United States Patent [19]

O'Brien

[11] 4,306,510

[45] Dec. 22, 1981

[54] ADJUSTABLE RUG HOOKING IMPLEMENT

[76] Inventor: Bertha O'Brien, 40 Elam St., North Kingstown, R.I. 02852

[21] Appl. No.: 149,652

[22] Filed: May 12, 1980

[51] Int. Cl.[3] ..... D05C 15/02

[52] U.S. Cl. .....112/80; 223/104; 66/118

[58] Field of Search ..... 112/80, 169; 66/117, 66/1, 1 A, 118, 4, 116; 223/104, 102; 81/3 R, 444, 443

[56] References Cited

U.S. PATENT DOCUMENTS

| | | | |
|---|---|---|---|
| 1,464,897 | 8/1923 | Atkinson | 112/80 |
| 1,878,889 | 9/1932 | Roberts | 112/80 |
| 2,097,380 | 10/1937 | Morgan | 112/80 |
| 2,610,598 | 9/1952 | Midas | 112/80 |
| 3,050,896 | 8/1962 | Parker | 223/104 X |
| 3,938,452 | 2/1976 | Windle | 223/104 X |

*Primary Examiner*—Ronald Feldbaum

*Attorney, Agent, or Firm*—Salter & Michaelson

[57] ABSTRACT

A rug hooking implement in which a needle is longitudinally moveable within the confines of the longitudinally oriented body of a handle. Such movement is brought about so as to adjust the projection of the needle forwardly of the body. This is accomplished by the interaction between a threaded needle shank and an adjustment wheel. The adjustment wheel is mounted upon the threaded shank and in effect captured by a rear portion of the body. A longitudinally oriented body slot enables a pin to radially inwardly extend through the slot and in contact with the needle so as to prevent rotation of the needle and its threaded shank. As the slot opens through the outer surface of the body, it forms the means by which the forward and rear movement of the needle is regulated as well as an indicating device as to the exact position of the needle with respect to the body.

6 Claims, 5 Drawing Figures

ADJUSTABLE RUG HOOKING IMPLEMENT

BACKGROUND AND SUMMARY OF THE INVENTION

This invention relates to an art or craft implement and particularly one adapted for hooking rugs and the like. Tools of this character usually include a handle with a tubular needle through which yarn or thread extend. The needle is pointed at one end whereby it may be projected through the fabric forming the foundation of the rug or other item so as to form loops at the backing face. It is therefore advantageous to be able to regulate the height of such formed loops and in this regard means are generally provided for adjusting the length which the needle projects from the forward end of the housing or body of the handle.

Various mechanisms for accomplishing these end results are now utilized but the need still exists for a device of improved construction which accomplishes such overall results. A still further desirable feature of implements of this type is the provision of an adjustment device for use in the above described implement which also may be readily observable by the user such that the desired height of the formed loops may be more readily and easily controlled.

Other objects, features and advantages of the invention shall become apparent as the description thereof proceeds when considered in connection with the accompanying illustrative drawing.

DESCRIPTION OF THE DRAWING

In the drawing, which illustrates the best mode presently contemplated for carrying out the present invention.

DESCRIPTION OF THE INVENTION

Figure 1:
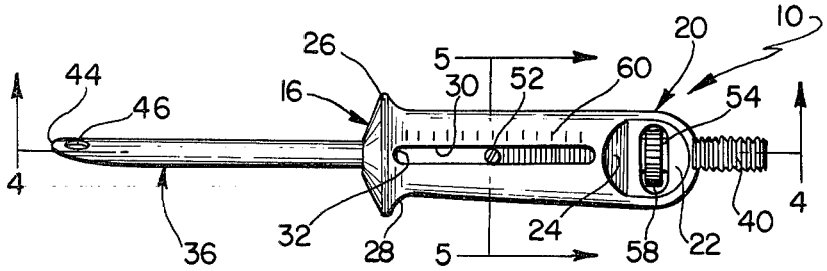
FIG. 1 is a side elevational view of a rug hooking implement disclosing the features of the present invention.
Figure 2:
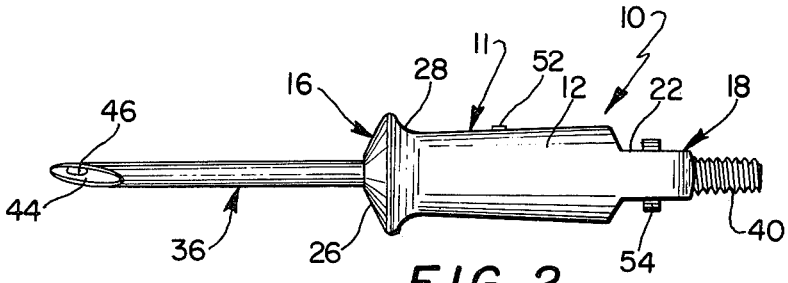
FIG. 2 is a top plan view thereof.
Figure 3:
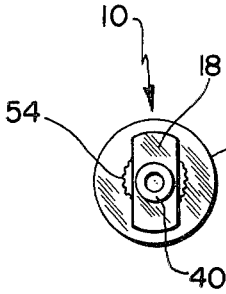
FIG. 3 is a side view taken from the right hand side of the FIG. 2.
Figure 4:
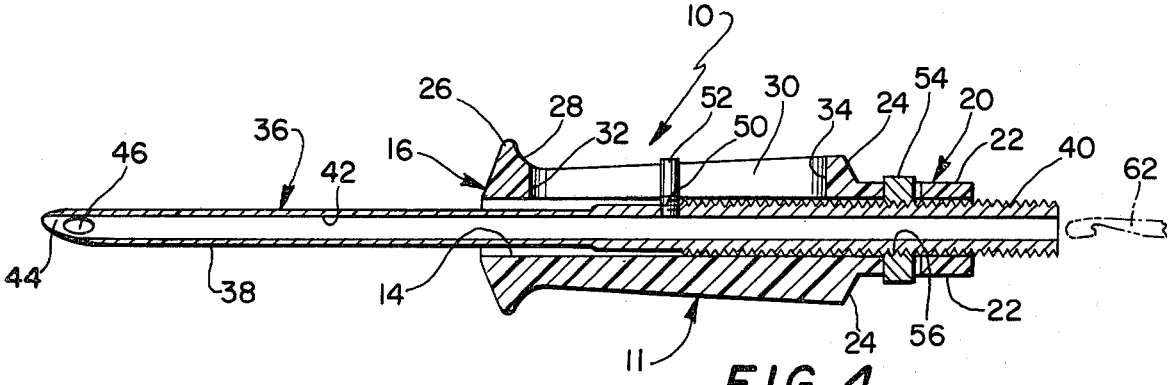
FIG. 4 is a sectional view taken along line 4—4 of FIG. 1.

As may best be seen by reference to the drawing, the implement or device 10 includes a handle 11 having a generally elongated body 12. The handle body 12 includes a smooth wall bore 14 extending entirely therethrough so as to present openings at opposite forward and rear body ends 16 and 18 respectively. The rear body end 18 includes an extension 20 which includes a pair of opposed generally planar side walls 22. The side walls 22 merge with the remaining portions of the generally cylindrical body 12 via a pair of opposed upwardly angled shoulders 24. The forward end 16 of the body 12 terminates in a radially outward directed flange 26. In that regard, the flange 26 serves to present an outwardly extending shoulder surface 28 which forms a convenient thumb and finger grasping area when the body or handle is used to manipulate the implement in the desired manner. The body 12 is also provided with a closed longitudinally oriented slot 30 which terminates at opposite ends thereof in front and rear surface walls 32 and 34 respectively. Slot 30 opens into the bore

14 and extends upwardly through remaining portions of the body.

A needle 36 is adapted for positioning with respect to the handle body 12 such that a part of a reduced diameter portion 38 projects forwardly thereof and part of a threaded shank portion 40 projects rearwardly thereof. The overall configuration of the needle 36 is that of an elongated tube, that is, it is provided with a longitudinal passageway 42 entirely therethrough. The passageway is to accomodate a textile strand i.e. yarn, thread, etc. depending on the craft use to which the implement is being applied. The forward reduced diameter portion 38 of the needle terminates in a beveled point 44 which in turn is provided with an opening 46.

Figure 5:
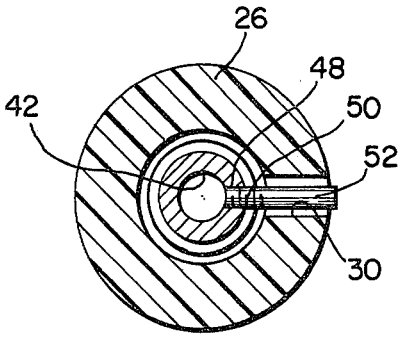
FIG. 5 is a cross-sectional view taken along the line 5—5 of FIG. 1.

The enlarged shank portion 40 of the needle is preferably provided with a radially extending threaded bore 48 into which the threaded end 50 of pin 52 is adapted for interconnection as best shown in FIG. 5 of the drawing. The pin 52 extends through the slot 30 and thus as hereinafter will be brought out prevents relative rotation of the needle 36 with respect to the body 12.

In order to facilitate the adjustable longitudinal movement of the needle 36 with respect to the body 12, an adjustment wheel 54 having an internally threaded bore 56 is positioned at the rear body end 18 within an opening 58 laterally extending therethrough and in such a manner that portions of the opposite outer surface of the adjustment wheel 54 extend above the planar surface 22. The outer surfaces of the wheel 54 may be provided with knurls so as to better facilitate thumb and finger engagement therewith so as to accomplish the desired turning action. The wheel 54 is thus held by its cooperative mounting upon the threaded shank portion 40 of the needle 36 and its disposition within the slot 58 from longitudinal movement with respect to the body 12. Accordingly, upon rotation of the wheel 54, the needle 36 is moved back and forth within the bore 14. As previously brought out, rotation of the needle 36 is prevented by means of the interaction of pin 52 with respect to the sides of the slot 30.

Indicia 60 is provided on the outer face of the body 12 proximal the slot 30 such that the pin 52 additionally provides a ready indication of the extent to which the forward portion 38 of the needle projects outwardly of the body within predetermined limits set by the coaction of the pin 52 and with slot end walls 32 and 34. In this regard it should be clear that the needle 36 may move longitudinally with respect to the body until the pin 52 engages the forward end wall 32 and rearwardly with respect to the body until the pin engages the rear end wall 34. Thus the longitudinal extent of the slot 30 determines the longitudinal adjustment or travel of the needle with respect to the body. It should also be pointed out that once this position has been set as by turning the adjustment wheel 54, that the needle will thereafter not normally move longitudinally with respect to the body of the handle unless readjusted. Thus the craft artisan by merely occasionally checking the position of the pin 52 can determine that the desired maximum projection of the needle and accordingly that the formed yarn loops will be in the desired range.

The diameters of the bore 14 and the shank portion 40 of the needle are such that they provide a relatively close engagement therebetween which, however, permits free slidable movement unless restricted by the adjustment wheel 54 as above indicated. Accordingly, wobble of the needle 36 with respect to the handle is essentially prevented. In addition, the shoulders 24 provide a secondary area in which the device may be grasped between the thumb and forefinger and pushed in the desired movement through the fabric backing of rug etc. in the intended manner although the shoulder 28 formed by the flange 26 is primarily adapted for such purposes. In operation, a threading hook 62 of conventional design is utilized to hook a continuous strand of yarn etc. into and through the needle opening 46. Thereafter upon each successive thrust of the implement 10 through the fabric backing or foundation of the craft item up to the point where the flange 26 engages the lower surface of such backing, the withdrawal of the implement through the backing forms a yarn loop of the desired height at the forward face of the backing. In this regard, the closed hole 46 in distinction from an open slot in the point of the needle assists in maintaining yarn or other strand in the desired postions within the interior of a needle.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An implement for rug hooking and the like, comprising an elongated body having a bore longitudinally extending therethrough, said bore opening at opposed forward and rear ends of said body, a tubular needle having a hollow threaded shank positioned in said bore with the pointed end thereof projecting outwardly of said forward body end and the threaded shank end thereof adapted for projection outwardly of said rear body end, said rear body end including a laterally extending opening communicating with said bore, an adjustment wheel having an internally threaded bore positioned in said opening with said shank threadably received in said wheel bore so as to longitudinally fix the position of said needle and at least portions of said wheel laterally outwardly projecting from said rear body end whereby rotational movement of said wheel adjustably moves said needle back and forth with respect to said body within predetermined forward and rear limits.

2. The implement as set forth in claim 1 or 4, said body of generally cylindrical configuration and terminating at the forward end thereof in a radially outwardly flared portion in turn forming both a finger and thumb rest for pushing said needle into and through a rug backing and the like and a forward stop for limiting the projection of said needle through said backing.

3. The implement as set forth in claim 1, said body of generally cylindrical configuration and terminating at the rear end thereof in a projection having opposed generally flat side walls through which said laterally disposed opening extends, said adjustment wheel projecting outwardly of each of said side walls for manipulative turning access.

4. The implement as set forth in claim 2, said body rear end side walls forming a pair of opposed outwardly projecting shoulders at the juncture of said rear end with the remaining body portions, said shoulders and said side walls forming a secondary finger and thumb rest for manipulation of said implement.

5. The implement as set forth in claim 1, 2 or 4, said body including a longitudinally directed slot extending between the body outer surface and said bore thereof, said slot terminating at longitudinally opposed forward and rear walls, a pin member extending radially through said slot and engaged with said needle so as to prevent rotational movement of said needle with respect to said body by contacting the walls of said slot and whereby said longitudinal movement of said needle caused by said wheel moves said pin back and forth along said slot so as to provide a measured visual indication of the projection of said needle out of said body forward portion.

6. The implement as set forth in claim 5, said body including indicia proximal said slot, said pin thus forming a combination indicating and locking means, said pin threadably received in said needle shank at one end and provided with rotation means at the other end.

* * * * *